United States Patent [19]

Jaquay et al.

[11] Patent Number: 4,490,237

[45] Date of Patent: Dec. 25, 1984

[54] PROCESS FOR RECOVERING HEAT FROM THE COMBUSTION OF RESIDUAL CARBON IN OIL DEPLETED SHALE

[75] Inventors: Louis H. Jaquay, Upper St. Clair, Pa.; Albert C. Mengon, deceased, late of Beaver, Pa., by Mary A. Mengon, administratrix

[73] Assignee: Dravo Corporation, Pittsburgh, Pa.

[21] Appl. No.: 510,289

[22] Filed: Jul. 1, 1983

[51] Int. Cl.[3] ..... C10G 1/02; C10B 51/00; C10B 49/06

[52] U.S. Cl. ..... 208/11 R; 201/29

[58] Field of Search ..... 208/11 R; 201/13, 14, 201/28, 32, 34, 37, 40, 29; 431/2, 8

[56] References Cited

U.S. PATENT DOCUMENTS

| | | | |
|---|---|---|---|
| 2,752,292 | 6/1956 | Scott, Jr. | 201/29 X |
| 2,814,587 | 11/1957 | Van Dijck | 208/11 R |
| 2,982,701 | 5/1961 | Scott, Jr. | 208/11 R |
| 3,318,798 | 5/1967 | Kondis et al. | 201/34 X |
| 3,331,754 | 7/1967 | Mansfield | 201/28 |
| 3,384,569 | 5/1968 | Peet | 208/11 R |
| 3,503,869 | 3/1970 | Haddad et al. | 201/29 X |
| 3,520,795 | 7/1970 | Schulman et al. | 201/29 X |
| 3,526,586 | 9/1970 | Saxton | 208/11 R |
| 3,617,468 | 11/1971 | Reyburn et al. | 208/11 R |
| 3,619,405 | 11/1971 | Smith | 208/11 R |
| 3,634,225 | 1/1972 | Garbett | 201/28 X |
| 4,092,237 | 5/1978 | Reed | 208/11 R |
| 4,161,442 | 7/1979 | Auden et al. | 208/11 R |
| 4,297,201 | 10/1981 | Jones et al. | 201/29 X |
| 4,388,174 | 6/1983 | Magedanz et al. | 201/32 X |

*Primary Examiner*—Delbert E. Gantz
*Assistant Examiner*—Glenn A. Caldarola
*Attorney, Agent, or Firm*—Parmelee, Miller, Welsh & Kratz

[57] ABSTRACT

As hot oil depleted shale from an indirect retorting process passes downward through a vertical shaft furnace, the residual carbon in the shale is burned out in the upper portion by air fed into the top of the furnace. The temperature of combustion is moderated by an inert gas also fed into the top of the furnace. Additional inert gas fed into the bottom of the furnace flows upward in countercurrent contact with the descending hot shale to cool the shale and heat the inert gas. The downwardly flowing gases from the upper, combustion portion of the furnace and the upwardly flowing gas from the lower, cooling portion are withdrawn from the furnace intermediate the upper and lower portions. The inert gas can be recycle gas which is heated by direct contact with the hot shale, a separate inert gas which is circulated through the heat exchanger to heat the recycle gas or a combination of the two.

8 Claims, 3 Drawing Figures

PROCESS FOR RECOVERING HEAT FROM THE COMBUSTION OF RESIDUAL CARBON IN OIL DEPLETED SHALE

FIELD OF THE INVENTION

This invention relates to a process for the combustion of the residual carbon in oil depleted shale and to the recovery of the heat of combustion for use in indirect retorting of additional oil shale. More particularly, it relates to the regulation of the temperature of combustion of the residual carbon and to the direct or indirect heating of the recycle gas used for indirect retorting.

PRIOR ART

It is well known that oil can be liberated from oil shale by passing hot gases through the shale to vaporize the oil constituents and entrain them in the gas which is then passed through a separator to recover the oil. There are two basic methods for heating the gases. In the direct method of retorting, the gases are heated in situ by the injection above or into the oil shale bed of an oxygen containing gas which supports combustion of a fuel added to the bed, some of the residual carbon in the oil shale and possibly some of the oil from the shale. In the indirect method of retorting, inert gases are heated externally of the retort before being circulated through the oil shale.

In the direct retort method only a small amount of the residual carbon in the oil shale is utilized to generate heat for the process. In the indirect method, none of the carbon is burned and all of the heat required must be met by the externally heated inert gas.

While vertical retorts can be used for retorting oil shale, indications are that the traveling grate retort is to be preferred from a technical and economic standpoint for a commercial installation. Both straight or circular traveling grates are adaptable to either the direct or indirect retorting method. While the direct retort method has the advantage of a higher oil production per unit area of the grate, the indirect retort method renders a higher oil yield per ton of shale and produces a process gas that is of better quality. The present method is directed to improvements in the indirect retorting through utilization of the heat available through combustion of the residual carbon in the oil depleted shale discharged from the retort and in controlling the temperature of combustion.

It is known to burn out the residual carbon in oil depleted shale for use in heating a gas to indirectly retort fresh oil shale. For instance, in U.S. Pat. No. 3,644,193 air is passed through oil depleted shale in a traveling grate to burn out the residual carbon with the hot combustion gases being used to heat alumina balls which in turn heat an inert gas used in the indirect retorting of fresh oil shale upstream on the traveling grate. U.S. Pat. No. 3,617,466 teaches that off-gas from a vertical retort can be burned externally to the retort with the combustion gases recycled to control the temperature in the retort and prevent clinker formation. U.S. Pat. No. 4,218,034 suggests combusting recycled gas outside a vertical retort and returning the combustion products to the retort in order to control carbonate decomposition, coking or carbonization of the gas, total gas flow and the heat requirements of the system. In U.S. Pat. No. 4,297,201, the residual carbon in retorted shale is burned out in a vertical kiln separate from the retort vessel. An inert gas is fed into the middle of the kiln together with air in order to control the combustion temperature. Additional inert gas fed into the bottom of the vertical kiln to recover the heat generated by the combustion process is withdrawn at the top together with the combustion gases and diluting inert gas and is circulated through a first heat exchanger to generate steam and a second heat exchanger to heat recycle gas for the indirect retorting of fresh shale.

SUMMARY OF THE INVENTION

According to the present invention, hot shale from which the oil has been recovered through indirect retorting with hot recycle gas, is charged into the top of a vertical shaft furnace for descending passage therethrough. An oxygen containing gas, such as air, is fed into the upper portion of the furnace for concurrent flow downward with the hot, oil depleted shale to effect combustion of the residual carbon in the shale in the upper portion of the furnace. In order to control the temperature of combustion and preclude the wasteful decomposition of the carbonates in the shale, a cool, inert gas is fed into the upper portion of the furnace for downward flow with the oxygen containing gas. Preferably, the cool inert gas is introduced at a point below the oxygen containing gas input so that it moderates the temperature in the combustion zone without inhibiting ignition of the residual carbon. The hot spent shale continues downward through the lower portion of the furnace where it is contacted by additional cool, inert gas which is introduced into the bottom of the furnace and flows upward countercurrent to the flow of the shale. This countercurrent, direct contact between the hot spent shale and the inert gas heats the inert gas and cools the oil and carbon depleted shale which is then discharged from the bottom of the furnace.

The combustion gases and heat absorbing inert gas which flow downward from the upper portion of the furnace, and the heated, additional inert gas which flows upward from the lower portion of the furnace are withdrawn from an intermediate portion of the furnace for recovery of the heat therein for indirect retorting of fresh oil shale. The splitting of the gas flow in the furnace so that the gases flow downward in the upper, combustion zone and upward in the lower, cooling zone provides for more efficient and more precise control of the process. Since the cooling portion of the inert gas is not passed through the combustion zone, the oxygen containing gas is not as diluted as in prior art arrangements and can thereby be more efficiently utilized. At the same time, energy is saved in not having to force the cooling gases through the entire burden of shale. Furthermore, the likelihood of developing localized columns of gas flow through the combustion zone is reduced when less gas is forced through this zone.

The heating of the recycle gas used in indirect retorting of fresh oil shale utilizing the latent heat and the heat generated by the combustion of the residual carbon in the hot, oil depleted shale can be accomplished either directly and/or indirectly. In the direct approach, the inert gas which is used to moderate the combustion temperature and the inert gas used to cool the hot, spent shale is the recycle gas used in the indirect retorting process and from which the vaporized oil has been removed. In the indirect approach, a separate inert gas is circulated through the furnace and a heat exchanger which transfers heat to the recycle gas. The direct approach has the advantage of simplicity and the elimination of the need for the very large heat exchanger required in the indirect approach. On the otherhand, the indirect approach maintains the high quality of the recycle gas since it is not diluted by combustion gases as in the direct approach.

In the indirect approach to heating the recycle gas, the excess of the cool, inert gas discharged by the heat exchanger can be passed through a second heat exchanger to heat the oxygen containing gas prior to its introduction into the furnace and to further cool the inert gas for other uses in the plant such as for sealing gas where the retort is a traveling grate.

In the combined direct and indirect approach, recycle gas is passed upwardly through the lower portion of the furnace to cool the spent shale and heat the recycle gas, as in the direct method, while the downwardly flowing combustion and temperature moderating gases are withdrawn separately from the lower regions of the upper portion of the furnace and passed through a heat exchanger to heat additional recycle gas as in the indirect method. This combined approach reduces the size of the heat exchanger over that required in the indirect approach while providing a higher quality recycle gas than that made available by the direct approach alone.

BRIEF DESCRIPTION OF THE DRAWINGS

The above as well as other features and advantages of the invention will become apparent through consideration of the following detailed description in connection with the accompanying drawings in which.

DETAILED DESCRIPTION OF THE INVENTION

Figure 1:
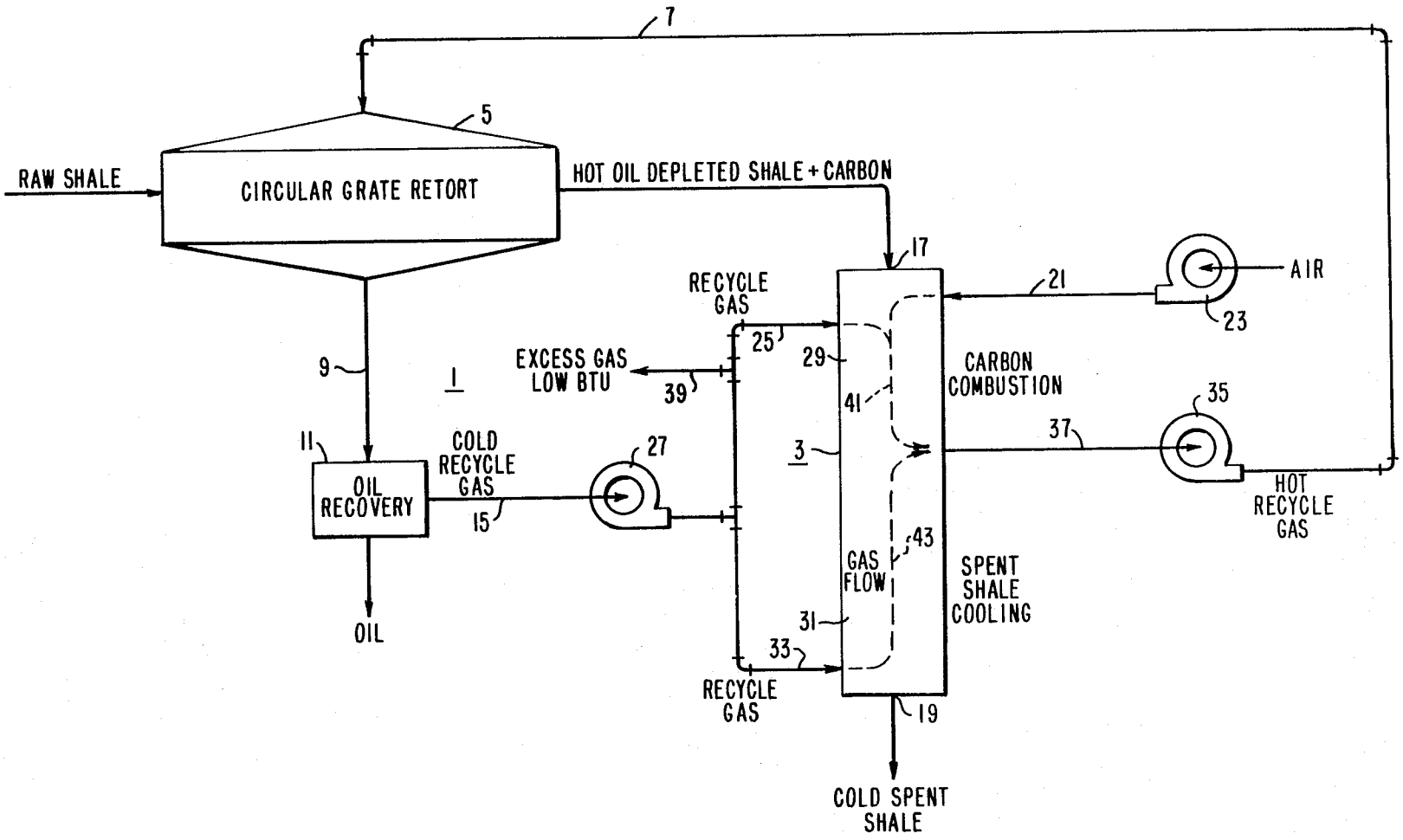
FIG. 1 is a schematic diagram of a process and apparatus for carrying out the invention wherein the recycle gas is heated by direct contact with combusted spent shale.

The first embodiment of the invention is illustrated schematically in FIG. 1 where a gas recirculation system for the recovery of thermal energy from oil depleted shale is generally indicated by the reference character 1 and includes a vertical shaft furnace 3. The process is shown in combination with a traveling grate 5 which indirectly retorts oil bearing shale. For the purpose of this description, 2000 lbs. of raw shale is charged to the retort.

The 2000 pounds of 25 gallon per ton shale is indirectly retorted by 42500 SCF of recycle gas supplied to the retort 5 through line 7 at a temperature of about 1200° F. The oil liberated from the shale is entrained in the recycle gas which is transported through line 9 to heat exchanger 11 where 190 lbs. of oil are separated and discharged through line 13. About 43,000 SCF of oil free recycle gas cooled to a temperature of about 120° F. is discharged by heat exchanger 11 into line 15.

The 1813 lbs. of hot, oil depleted shale discharged from the grate 5 at a maximum temperature of about 1000° F., is immediately charged into the top 17 of the vertical shaft furnace 3. The hot, oil depleted shale descends through the furnace and is discharged at the bottom 19. As the hot oil depleted shale passes downward, an oxygen containing gas is introduced into the upper region of the furnace 3 through line 21 by blower 23 in order to effect combustion of the residual carbon in the hot oil depleted shale. Approximately 8100 SCF of air at a temperature of about 77° F. satisfies the stoichiometric requirements for combustion.

The temperature of combustion of the oil depleted shale during residual carbon combustion in the vertical shaft furnace 3 must be controlled to prevent the decomposition of the calcium and magnesium carbonates in the shale. The endothermic reaction resulting from such decomposition of the carbonates would cause a significant energy loss in this energy recovery process. Accordingly, it is preferred that the temperature of combustion be limited to about 1300° F.

The residual carbon combustion temperature is controlled by the introduction of cooled, recycle gas into the vertical shaft furnace 3 to absorb excess heat. Cooled recycle gas discharged from the oil recovery heat exchanger 11 into the line 15 at a temperature of about 120° F. is introduced through line 25 by blower 27 into the upper portion of the furnace 3 generally indicated at 29. It is in this upper portion of the furnace that the combustion of the residual carbon in the oil depleted shale is most intense and where, therefore, temperature control must be effected. About 23,700 SCF of recycle gas at 120° F. will maintain the 1813 pounds of combusting oil depleted shale at or below the preferred maximum temperature of about 1300° F. Preferably, the temperature moderating recycle gas is introduced into the upper portion 29 of the furnace at a point below the introduction of the oxygen containing gas so as not to inhibit ignition of the residual carbon.

The combusted hot spent shale, that is, oil depleted shale from which substantially all the residual carbon has been combusted, descends into the thermal energy recovery zone 31 where additional cooled, recycle gas, introduced at the bottom of the furnace 3 through line 33, flows upward in countercurrent contact with the hot spent shale to heat the recycle gas and cool the spent shale. About 19,000 SCF of cooled recycle gas from line 33 at a temperature of about 120° F. enters the bottom portion of the furnace. Through recovery of thermal energy from the combusted spent shale in the lower portion 31 of the furnace and through the absorbtion of thermal energy during combustion of the residual carbon in the upper portion 29 of the furnace, the recycle gas from both lines 33 and 25 is heated to a temperature of about 1200° F. This heated recycle gas, together with the gaseous products of combustion generated in the upper portion 29, is withdrawn by blower 35 from the furnace 3 at an intermediate level through line 37. About 42,500 SCF of hot recycle gas is recirculated back to the traveling grate retort 5 through the line 7. Excess recycle gas generated by the system is discharged as cooled gas at a temperature of about 120° F. through line 39. This recycle gas is a low BTU gas due to the presence of the gaseous products of the combustion of the residual carbon in the shale.

As indicated by the dotted line 41 in FIG. 1, the downward flowing oxygen containing gas introduced through line 21, the temperature moderating recycle gas introduced through line 25 and the combustion gases generated by the burning of the residual carbon in the oil depleted shale only pass through the upper portion 29 of vertical shaft furnace 3 before being withdrawn at an intermediate point through line 37. Similarly, the upwardly flowing recycle gas introduced through line 33 only passes through the lower portion 31 of the furnace as indicated by the dotted line 43. This arrangement permits more precise control of the temperature of combustion of the residual carbon since the oxygen containing gas is not diluted by the flow of the cooling gas through the combustion zone. In addition, less energy is required for the system since the gases are only being circulated through the parts of the shale burden necessary to perform their function rather than through the entire burden. Also there is less likelihood of blowouts since not as much heat is required to force the gases through the burden.

Figure 2:
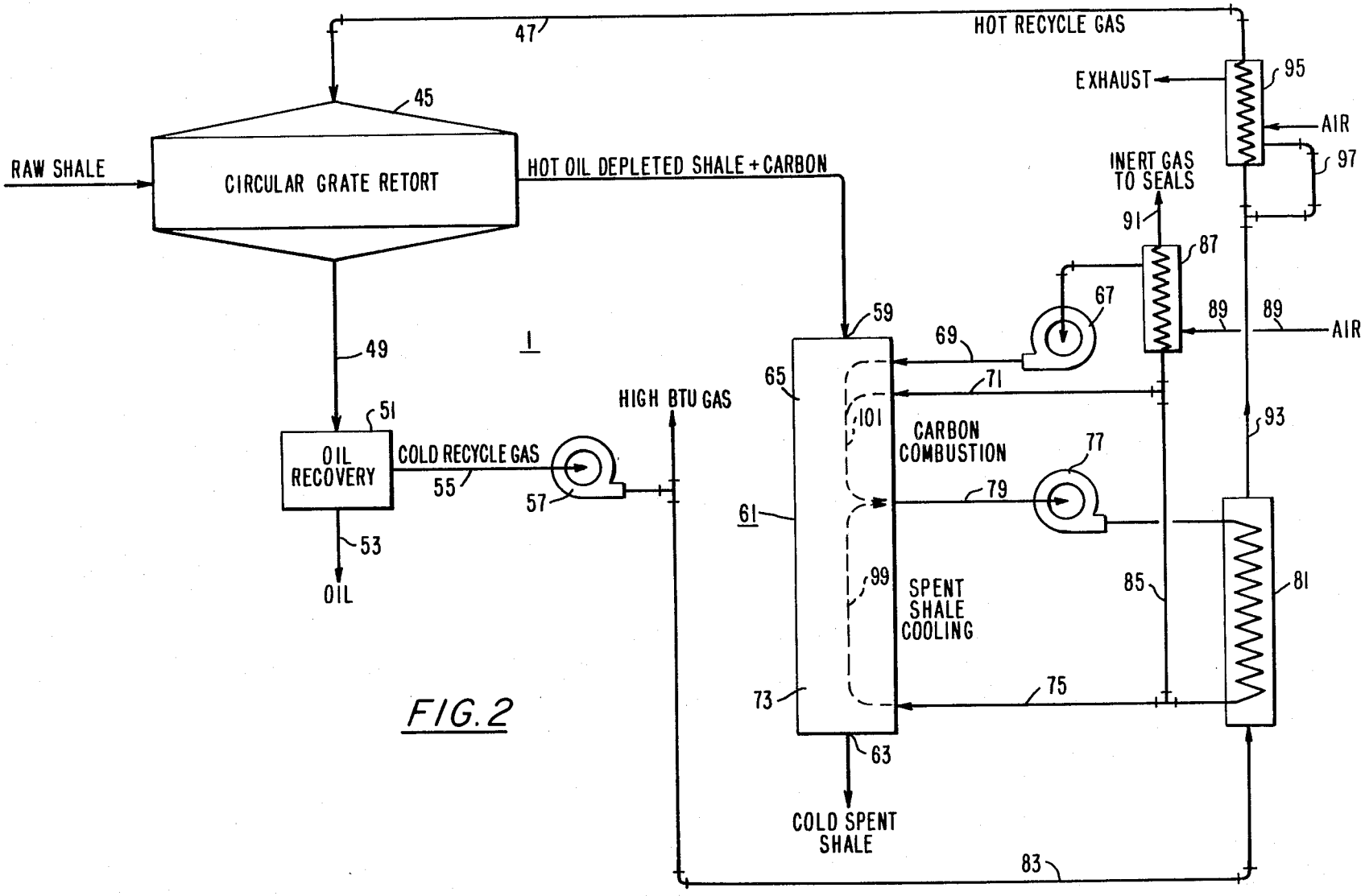
FIG. 2 is a schematic diagram of a process and apparatus for carrying out the invention wherein the recycle gas is heated indirectly in a heat exchanger by an inert gas which is circulated through the combusted, spent shale.

FIG. 2 illustrates a second embodiment of the invention in which an inert gas is used to recover the heat of combustion of the residual carbon in the oil depleted shale and to control the temperature of combustion with the recycle gas being heated indirectly by the hot inert gas and the gaseous products of combustion. In this example 2000 pounds of fresh shale are indirectly retorted on a traveling grate retort 45 by hot recycle gas supplied through line 47. The vaporized kerogen entrained in the recycle gas passes through line 49 to separator 51 where 190 pounds of oil are discharged through line 53 and 28,100 SCF of cooled, recycle gas are drawn off through line 55 by blower 57.

The 1813 pounds of hot, oil depleted shale which is discharged from the traveling grate retort 45 is charged into the top 59 of a vertical shaft furnace 61 at a maximum temperature of about 1050° F. The hot, oil depleted shale passes downward through the furnace 61 and is discharged at the bottom 63. As it descends through the upper portion 65 of the furnace, an oxygen containing gas is introduced by the blower 67 through line 69 to effect combustion of residual carbon in the oil depleted shale. About 7300 SCF of air which has been preheated to a temperature of about 150° F. in a manner to be discussed below, meets the stoichiometric requirements for combustion.

The temperature of combustion of the residual carbon in the oil depleted shale is moderated, for the reasons previously discussed, by the introduction of an inert gas into the upper portion 65 through line 71. The inert gas is the end product of the stoichiometric combustion of residual carbon in the oil depleted shale which has been cooled and recycled in a manner to be discussed shortly. About 23,700 SCF of this inert gas at a temperature of 120° F. is sufficient to maintain the temperature of the combusting oil depleted shale at or below the preferred maximum temperature of 1300° F. Again, it is preferred that the moderating gas be introduced into the furnace at a level below that of air injection so that residual carbon ignition is not inhibited.

The hot oil depleted, and now carbon depleted, spent shale passes downward from the upper, combustion portion 65 of the furnace into the lower, thermal recovery portion 73 where 11,000 SCF of inert gas introduced into the bottom of the furnace at a temperature of 120° F. through line 75 pass upward in countercurrent contact with the hot spent shale to effect heating of the inert gas and cooling of the shale. This upward flowing inert gas is heated to a temperature of about 1300° F. through contact with the hot spent shale and is withdrawn from an intermediate portion of the furnace by a blower 77 through line 79 together with the downwardly flowing temperature moderating inert gas from the upper portion 65 of the furnace and the combustion gases both of which are also at about 1300° F. The combustion gases serve as a make up component for the inert gas.

About 28,000 SCF of inert gas withdrawn from the furnace through line 79 is circulated by the blower 77 through one side of heat exchanger 81. Cooled, recycle gas at a temperature of about 120° F. is supplied to the other side of the heat exchanger 81 through line 83 by blower 57. In the heat exchanger 81, approximately 29,000 SCF of recycle gas is heated to about 1000° F. by the inert gas which in turn is cooled to about 200° F. Most of the cooled, inert gas is returned to the bottom of the furnace 3 through line 75; however, about 7350 SCF of excess inert gas is passed through line 85 to a second heat exchanger 87 where the air supplied through line 89 at a temperature of 77° F. is preheated to 150° F. prior to introduction into the furnace. The excess inert gas which is further cooled to about 90° F. in the heat exchanger 87 is available at line 91 for gas seals on the retort 45.

The hot recycle gas which is discharged from the heat exchanger 81 into line 93 at about 1000° F. may not generate sufficient heat to satisfy process requirements when retorting some grades of shale. Accordingly, the recycle gas can be passed through another heat exchanger 95 where a small amount of the high BTU recycle gas diverted through line 97 is burned with air to provide the balance of the heat needed. The hot recycle gas then passes from heat exchanger 95 through line 47 to the traveling grate retort 5 for processing additional oil shale.

As in the case of the embodiment of the invention described in connection with FIG. 1, the cooling gas in the FIG. 2 embodiment only flows through the lower portion 73 of the furnace 61 as indicated by the dotted line 99 while the temperature moderating gas together with the oxygen containing gas and the combustion gases only flow downward through the upper portion 65 as indicated by the dotted line 101. Thus this embodiment of the invention realizes the same economic and technical advantages discussed previously in connection with the first embodiment. This second embodiment produces a higher BTU recycle gas than the first since it is not diluted by the combustion gases. On the otherhand, the heat exchanger 81 is rather large thereby adding to the cost and size of the system.

Figure 3:
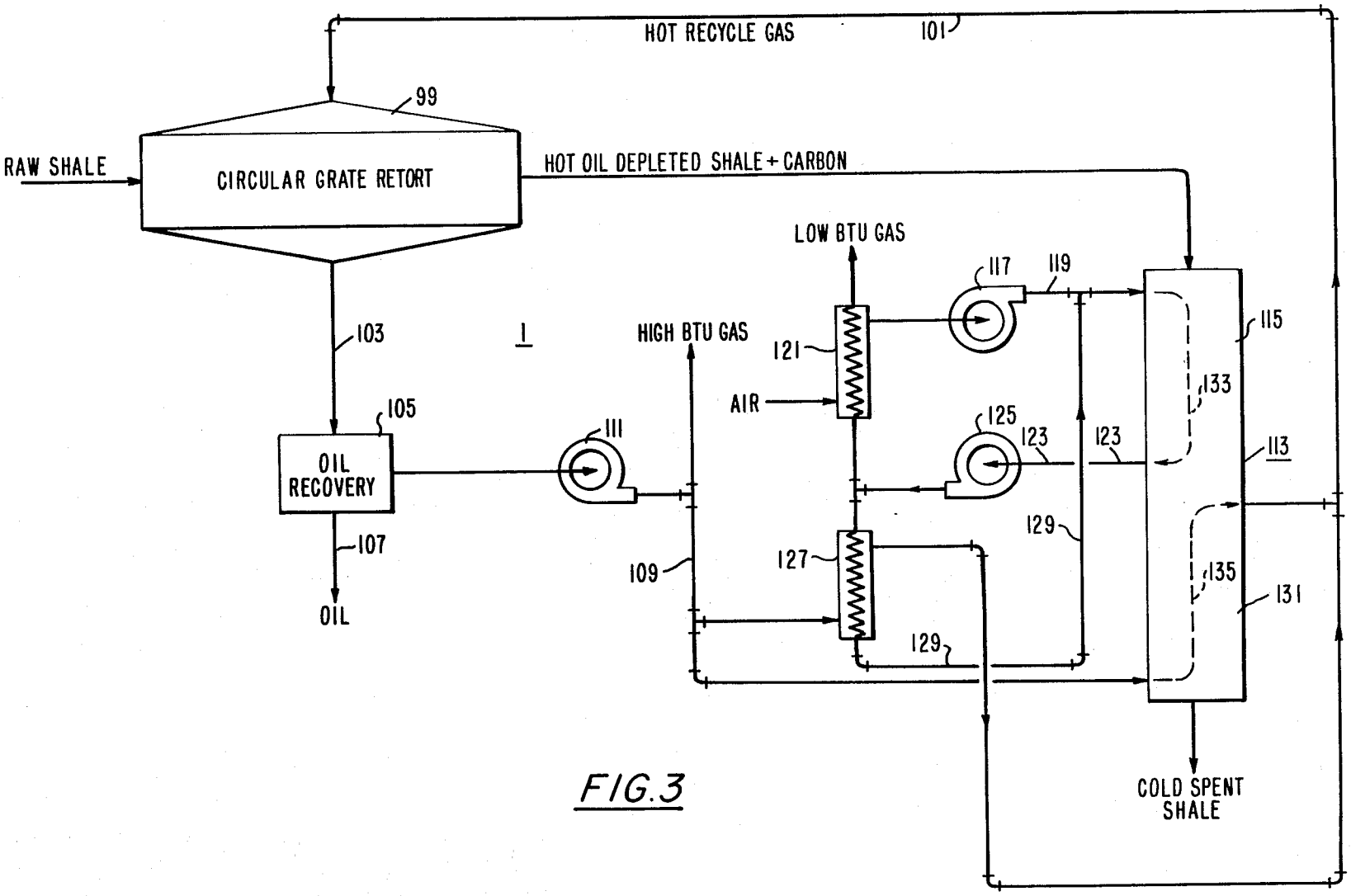
FIG. 3 is a schematic diagram of a process and apparatus for carrying out the invention wherein some of the recycle gas is heated directly as in FIG. 1 and some is heated indirectly as in FIG. 2.

FIG. 3 ilustrates a third embodiment of the invention in which some of the recycle gas is heated directly by passage upward through the lower portion of a shaft furnace, as in the direct approach typified by FIG. 1, and additional recycle gas is heated indirectly in a heat exchanger as in the approach shown in FIG. 2. In the example of the combined approach shown in FIG. 3, 2000 pounds of fresh 25 gallon per ton shale are indirectly retorted on a circular traveling grate 99 by about 31,300 SCF of hot recycle gas supplied through line 101 at a temperature of about 1200° F. The vaporized kerogen entrained in the recycle gas passes through line 103 to oil recovery unit 105 where 190 pounds of oil are discharged through line 107 and 31,900 SCF of cooled, recycle gas are drawn off through line 109 by blower 111.

The 1813 pounds of hot, oil depleted shale which is discharged from the circular traveling grate 99 is introduced into the top of shaft furnace 113, passes downward through the furnace and is discharged at the bottom. The hot, oil depleted shale enters the top of the furnace 113 at a temperature of about 1000° F. As it passes downward through the upper portion 115 of furnace 113, residual carbon in the shale is combusted by an oxygen containing gas, such as air, which is introduced near the top of the furnace through line 119 by a blower 117. Again about 7430 SCF of air which has been preheated to a temperature of about 900° F. in a heat exchanger 121 meets the stoichiometric combustion requirements.

The temperature of combustion in the upper portion 115 of furnace 113 is moderated by the introduction of a cooled inert gas near the top of the furnace either with the air through line 119 (as shown) or separately below the air inlet for the reasons discussed above. The inert gas is the gaseous end product of the stoichiometric combustion of the carbon in the oil depleted shale which is drawn from the lower region of the upper portion 115 of the furnace 113 through line 123 by blower 125 and passed through heat exchanger 127 before being recycled through line 129. About 16,600 SCF of this cooled, inert gas at a temperature of about 150° F. is needed to maintain the temperature of the combusting carbon in the oil depleted shale below the preferred maximum temperature of about 1300° F.

The combusted spent shale passes downward from the upper, combustion portion 115 of furnace 113 into the lower, thermal recovery portion 131 where the spent shale is cooled by the upward countercurrent flow of recycle gas from line 109 introduced into the lower regions of the furnace. About 13,800 SCF of cooled recycle gas enters the bottom of the furnace at a temperature of about 120° F. and is withdrawn from the upper region of the lower portion of the furnace as hot recycle gas at a temperature of about 1300° F. through the line 135. Additional recycle gas from line 109 is diverted through heat exchanger 127 where it too is heated to about 1300° F. by a portion of the hot gases withdrawn from the upper portion of the furnace before being directed to the circular grate retort 99 through line 101. Excess gas from the upper portion 115 of the furnace heats the incoming combustion air in heat exchanger 121 before being drawn off as low BTU gas. Excess recycle gas from the oil recovery unit is drawn off from line 109 as high BTU gas.

As in the case of the embodiments of the invention disclosed in FIGS. 1 and 2 the downwardly flowing oxygen containing gas and the inert temperature moderating gas introduced through line 119 and the combustion gases generated in the upper portion of furnace 113 of FIG. 3 only circulate through the upper portion of the furnace as indicated by the dashed line 133. Similarly the recycle gas introduced at the bottom of the furnace through line 109 only passes upwardly through the lower portion 131 of furnace 113 as indicated by the dashed line 135. Since the combustion gases are withdrawn from the furnace separately from the hot recycle gas, the BTU content of the latter remains high. And since only the products of combustion and the temperature moderating gases from the upper region are used to indirectly heat recycle gas the size of the heat exchanger is much smaller than that required in the example of FIG. 2.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A process for the combustion of the residual carbon in hot oil depleted shale from which the oil has been recovered through indirect retorting with hot recycle gas, and for recovering the heat generated thereby, said process comprising the steps of:

charging the hot oil depleted shale into the top of a vertical shaft furnace for descending passage therethrough;

feeding an oxygen containing gas into the upper portion of the vertical shaft furnace for downward flow concurrent with the hot oil depleted shale to effect combustion of the residual carbon therein resulting in the generation of combustion gases and hot spent shale;

introducing a cool, inert gas into the upper portion of said vertical shaft furnace for downward flow with the oxygen containing gas and the hot oil depleted shale to control the temperature of combustion of the residual carbon in the hot oil depleted shale and wherein said cool, inert gas is introduced into the upper portion of said vertical shaft furnace at a point below the level at which the oxygen containing gas is fed into the furnace such that ignition of the residual carbon in the hot oil depleted shale is not inhibited;

introducing additional cool, inert gas into the bottom portion of the vertical shaft furnace for upward flow countercurrent to the downward flow of the hot spent shale to cool and transfer the heat therein to said inert gas; and withdrawing the downward flowing inert gas and combustion gases and the upward flowing additional inert gas intermediate the upper and lower portions of said vertical shaft furnace.

2. The process of claim 1 wherein said cool, inert gas is recycle gas from which the oil has been removed and wherein the heated gases withdrawn from intermediate the upper and lower portions of said furnace are used to retort additional oil shale.

3. The process of claim 1 wherein at least a portion of the inert gas and combustion gases which flow downward through the upper portion of the furnace and are withdrawn intermediate the upper and lower portions are circulated through first heat exchanger means to indirectly heat recycle gas for indirect retorting of fresh oil shale and wherein the additional cool, inert gas introduced into the bottom portion of the furnace is additional recycle gas which is withdrawn from the furnace intermediate the upper and lower portions of the furnace separately from the gases withdrawn from the upper portion for indirect retorting of fresh oil shale.

4. A process for the combustion of the residual carbon in hot oil depleted shale from which the oil has been recovered through indirect retorting with hot recycle gas, and for recovering the heat generated thereby, said process comprising the steps of:

charging the hot oil depleted shale into the top of a vertical shaft furnace for descending passage therethrough;

feeding an oxygen containing gas into the upper portion of the vertical shaft furnace for downward flow concurrent with the hot oil depleted shale to effect combustion of the residual carbon therein resulting in the generation of combustion gases and hot spent shale;

introducing a cool, inert gas into the upper portion of said vertical shaft furnace for downward flow with the oxygen containing gases and the hot oil depleted shale to control the temperature of combustion of the residual carbon in the hot oil depleted shale;

introducing additional cool, inert gas into the bottom portion of the vertical shaft furnace for upward flow countercurrent to the downward flow of the hot spent shale to cool and transfer the heat therein to said inert gas; and withdrawing the downward flowing inert gas and combustion gases and the upward flowing additional inert gas intermediate the upper and lower portions of said vertical shaft furnace wherein the heated gases withdrawn from intermediate the upper and lower portions of said vertical shaft furnace are circulated through first heat exchanger means to heat recycle gas used in indirect retorting of additional oil shale and are then recirculated to the top and bottom of the furnace as said cool, inert gas.

5. The process of claim 4 wherein some of the cool inert gas is circulated through second heat exchanger means to heat the oxygen containing gas prior to its being fed into the upper portion of said vertical shaft furnace.

6. A process for the combustion of the residual carbon in hot oil depleted shale from which the oil has been recovered through indirect retorting with hot recycle gas, and for recovering the heat generated thereby, said process comprising the steps of:

charging the hot oil depleted shale into the top of a vertical shaft furnace for descending passage therethrough;

feeding an oxygen containing gas into the upper portion of the vertical shaft furnace for downward flow concurrent with the hot oil depleted shale to effect combustion of the residual carbon therein resulting in the generation of combustion gases and hot spent shale;

introducing a cool, inert gas into the upper portion of said vertical shaft furnace for downward flow with the oxygen containing gases and the hot oil depleted shale to control the temperature of combustion of the residual carbon in the hot oil depleted shale;

introducing additional cool, inert gas into the bottom portion of the vertical shaft furnace for upward flow countercurrent to the downward flow of the hot spent shale to cool and transfer the heat therein to said inert gas;

withdrawing the downward flowing inert gas and combustion gases and the upward flowing additional inert gas intermediate the upper and lower portions of said vertical shaft furnace wherein at least a portion of the inert gas and combustion gases which flow downward through the upper portion of the furnace and are withdrawn intermediate the upper and lower portions are circulated through first heat exchanger means to indirectly heat recycle gas for indirect retorting of fresh oil shale and wherein the additional cool, inert gas introduced into the bottom portion of the furnace is additional recycle gas which is withdrawn from the furnace intermittent the upper and lower portions of the furnace separately from the gases withdrawn from the upper portion for indirect retorting of fresh oil shale and wherein said gases withdrawn from said furnace and circulated through said first heat exchanger are reintroduced into the upper portion of said vertical shaft furnace as said cool inert gas.

7. The process of claim 6 wherein the remainder of the inert gas and combustion gas which flow downward through the upper portion of the furnace and are withdrawn intermediate the upper and lower portion are passed through a second heat exchanger to heat the oxygen containing gas prior to the latter being fed into the upper portion of the furnace.

8. The process of claim 7 wherein said remainder gases are withdrawn as low BTU gas after being circulated through the second heat exchanger.

* * * * *